US006234941B1

(12) United States Patent
Chu

(10) Patent No.: US 6,234,941 B1
(45) Date of Patent: May 22, 2001

(54) COMBINATION PRESS AND FLY MOTIONS EXERCISE APPARATUS

(76) Inventor: Yong Suk Chu, 1225 Raymond Ave., Glendale, CA (US) 91201

( * ) Notice: Subject to any disclaimer, the term of this patent is extended or adjusted under 35 U.S.C. 154(b) by 0 days.

(21) Appl. No.: 09/416,493

(22) Filed: Oct. 12, 1999

(51) Int. Cl.[7] ..... A63D 21/00

(52) U.S. Cl. ..... 482/100; 482/136; 482/137; 482/138

(58) Field of Search ..... 482/100, 136, 482/137, 129, 130, 138

(56) References Cited

U.S. PATENT DOCUMENTS 4,494,751 * 1/1985 Schnell ..... 482/136
4,949,951 8/1990 Deola .
5,080,351 1/1992 Rockwell .
5,120,289 * 6/1992 Yu ..... 482/137
5,277,684 1/1994 Harris .
5,290,214 3/1994 Chen .
5,665,036 9/1997 Hsieh .
5,788,614 8/1998 Simonson .

* cited by examiner

*Primary Examiner*—John Mulcahy
(74) *Attorney, Agent, or Firm*—Gene Scott-Patent Law & Venture Group

(57) ABSTRACT

An exercise machine provides a pair of arms positionable for completing chest presses and also for doing a fly type exercise. On each arm a knuckle is hinged between two orthogonal sockets so as to enable positioning of the arms in appropriate positions for the two exercises. The exerciser may move the arms apart for fly exercise motion or to a position in front of the chest for a press exercise motion.

2 Claims, 5 Drawing Sheets

COMBINATION PRESS AND FLY MOTIONS EXERCISE APPARATUS

BACKGROUND OF THE INVENTION

1. Field Of The Invention

This invention relates generally to exercise equipment and the like, and more particularly to an apparatus for exercising with the well known press and fly motions for arm and chest development.

2. Description of Related Art

The following art defines the present state of this field: Deola, U.S. Pat. No. 4,949,951 describes a body building exercise device that is provided on a frame with a vertically positioned inverted "U" shaped member pivotally connected to the frame at a median position. The lower ends of the "U" shaped member are connected to a weight stack through a cable and pulley mechanism. Two bar members are connected at one end through a universal connection to the bottom ends of the first member. At the free ends of the bar, gripping means are provided to allow a "dumbbell fly" movement of the bar members to attain constant forward push force level requirements in an equidistant plane in relation to the user's body independent of the resisting force supplied to the device from the weigh stack.

Rockwell, U.S. Pat. No. 5,080,351 describes a compact multi-function weight training exerciser employing handlebar levers that are angularly adjustable by releasable, splined connections with respect to the pivot shaft that they operate so that the rest positions of the respective levers can be disposed in various angularly displaced locations to enable the performance of a variety of exercises.

Harris, U.S. Pat. No. 5,277,684 describes a multi-function exercise apparatus which has a base frame including two vertical support members. An adjustable support means is secured to the frame and provides support for a user in a plurality of different upright and horizontal exercise positions. A lever arm is mounted to a fixed shaft extending from each of the two support members and an elastic band biasing means cooperatively engages each lever arm and corresponding support member thereof so that each lever arm is adapted to have its forward or rearward rotational bias changed without requiring removal and relocation of the lever arm, the corresponding elastic bands, or the corresponding band support pins.

Chen, U.S. Pat. No. 5,290,214 describes an exerciser including a generally horizontal top frame having a front end, a column supporting the top frame, a movable frame mounted on the top frame and movable between the front end of the top frame and the column, the movable frame having two spaced vertical hollow frame sections and a cross frame section interconnecting lowermost ends of the vertical hollow frame sections, two push arms connected pivotally to the movable frame and capable of being pivoted toward each other, and a stop rod extending frontward from the column below the top frame so as to limit movement of the movable frame toward the column. The exerciser further includes a first locking unit which is operable to prevent movement of the movable frame relative to the top frame and second locking unit which is operable to prevent movement of the push arms relative to the movable frame.

Hsieh, U.S. Pat. No. 5,665,036 describes an exercise apparatus which enables the user to selectively perform a bench press exercise or a butterfly exercise using the same apparatus elements without requiring any modification to the apparatus by the user. A pair of exercise arms are mounted to a pivot bar for pivoting movement each about a respective one of a pair of parallel pivot axes and are interconnected for concurrent pivoting movement in opposite angular directions about the pair of pivot axes by the respective intermeshed circular gear segments. The pivot bar is mounted to an overhead member for pivoting movement about a horizontal pivot axis. When a butterfly exercise is being performed, the apparatus provides equal resistance to both of the user's arms and insures that both arms move at the same speed. When a bench press exercise is being performed, the meshing of the circular gear segments locks the exercise arms together.

Simonson, U.S. Pat. No. 5,788,614 describes an apparatus and a method for performing a chest press exercise. A user support and a primary hinge are mounted to a frame. A secondary hinge is mounted to the primary hinge. An arm mounted to the secondary hinge has a handle adapted to be grasped by the user. The two hinges permit the user to displace the handle in either or both the longitudinal and lateral directions. A means for resisting the displacement of the handle, preferably in both the lateral and longitudinal directions, is provided. The resistance means may include a post attached to the arm for mounting eight plates. A second handle, arm, and secondary hinge may be provided for the other hand so that the user may exercise both halves of his body. The arms may be connected such that both handles move the same longitudinal and/or lateral distance. To use the exercise machine, a user selects a weight for exercise, lies on the user support, grasps the handle and pushes upward from his shoulders, moving the handle longitudinally and laterally as he so chooses overcoming for resistance.

The prior art teaches both press and fly exercise apparatus. However, the prior art does not teach that a single apparatus may be used for both such exercises in a manner whereby the athlete has the option to switch between these two exercises instantly. The present invention fulfills these needs and provides further related advantages as described in the following summary.

SUMMARY OF THE INVENTION

The present invention teaches certain benefits in construction and use which give rise to the objectives described below.

The present invention provides an exercise machine having a pair of arms positionable for completing chest presses and also for doing a fly type exercise. On each arm a knuckle is hinged between two orthogonal sockets so as to enable positioning of the arms in appropriate positions for the two exercises. The exerciser may move the arms apart for fly exercise motion or to a position in front of the chest for a press exercise motion.

A primary objective of the present invention is to provide an exercise apparatus having advantages not taught by the prior art.

Another objective is to provide such an apparatus having operator positioning of the arms at will for fly and for press type exercise motions while using a single resistance device.

A further objective is to provide such an apparatus having a means for maintaining tension in the resistance device over a range of motion necessary for proper exercise.

A still further objective is to provide such an apparatus having means for switching between fly and press exercise motions instantly.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings:

FIGS. 5–7 are top plan views thereof showing full or partial equipment positions wherein FIG. 5 shows the exercise arms in an non-extended attitude, FIG. 6 shows the arms laterally extended, and FIG. 7 shows the arms in a fly exercising motion.

DETAILED DESCRIPTION OF THE INVENTION

Figure 2:
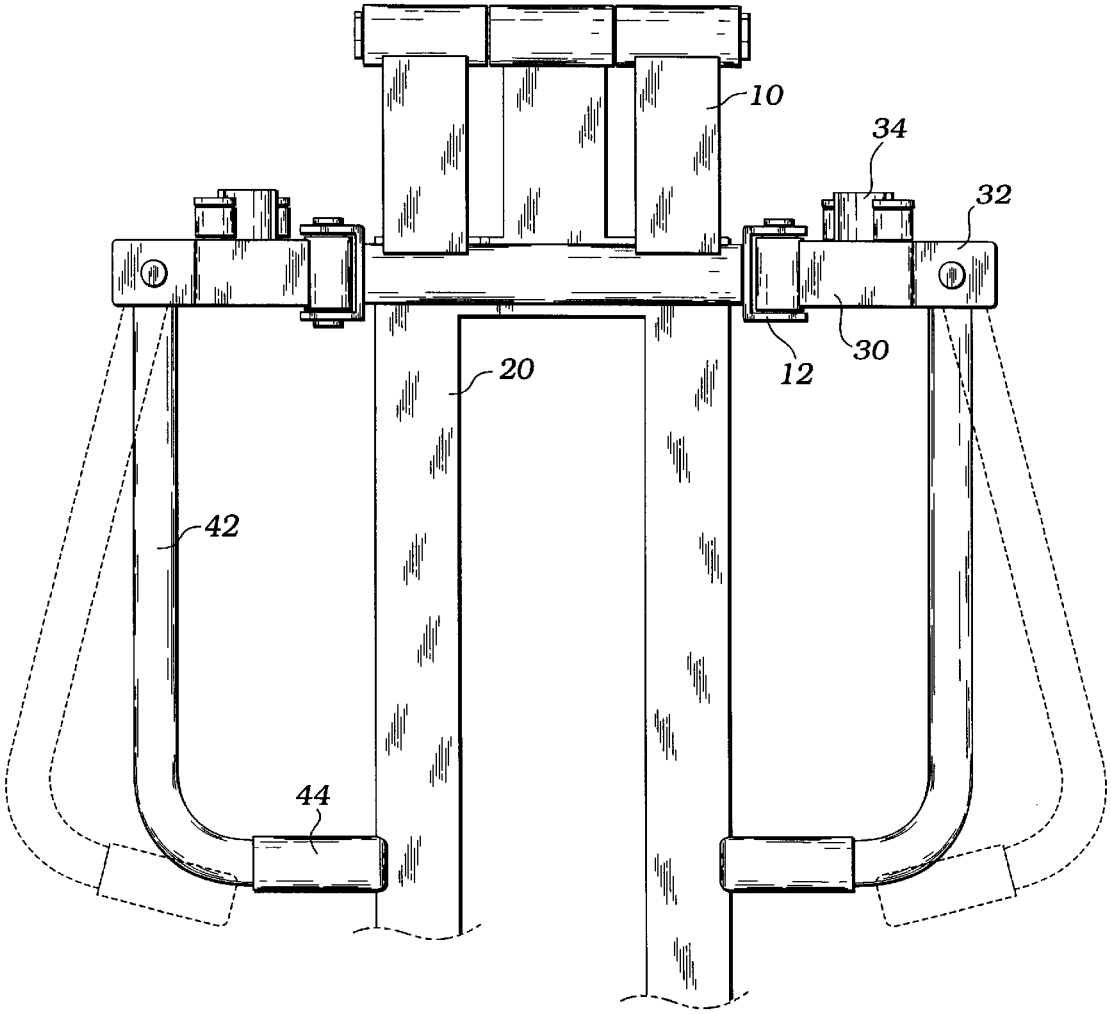
FIG. 2 is a front elevational view thereof showing alternate positions of a pair of exercise arms of the equipment thereof.
Figure 3:
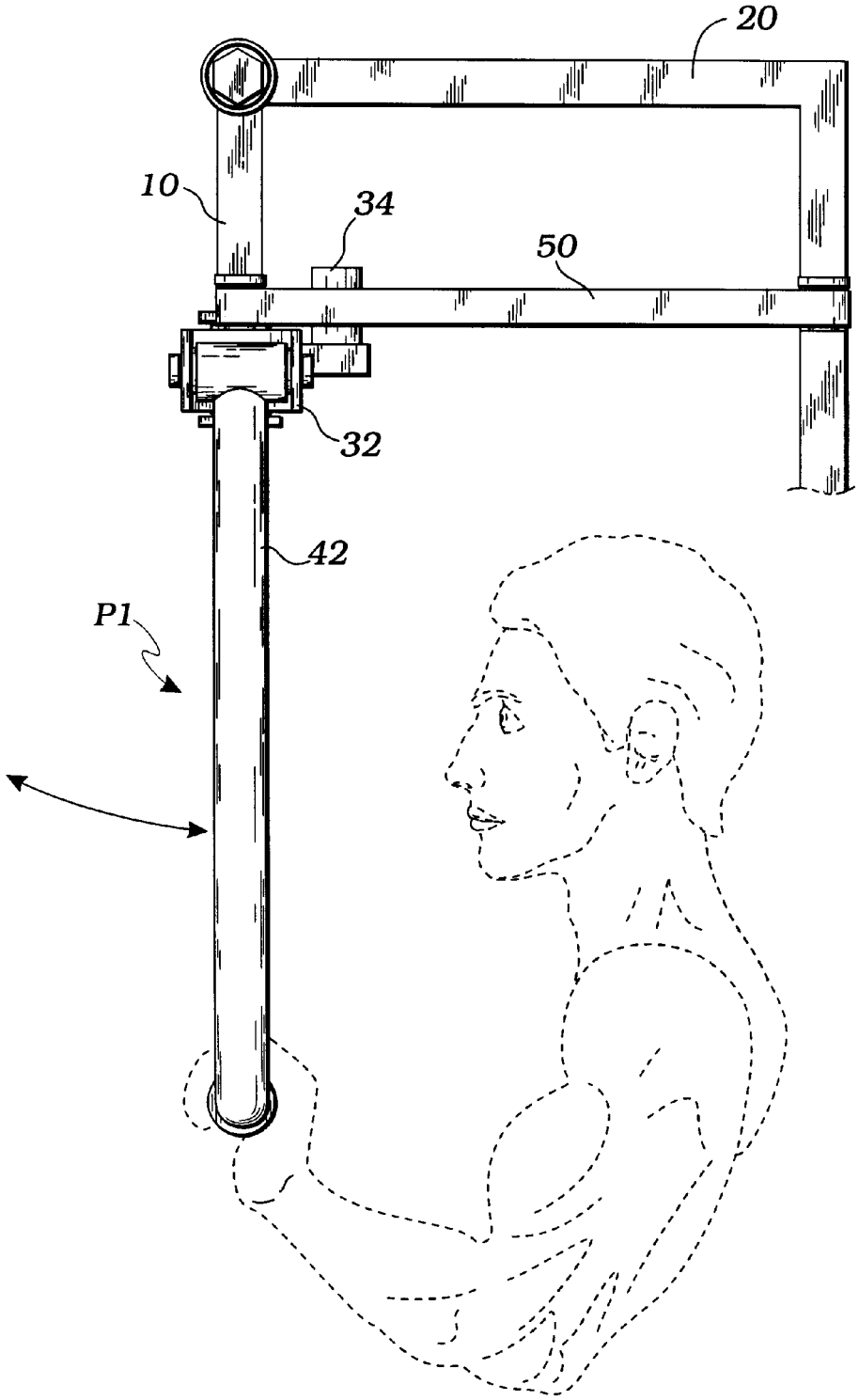
FIGS. 3 and 4 are side elevational views thereof showing a alternate positions of the exercise arms prior to, and after exertion respectively.
Figure 4:
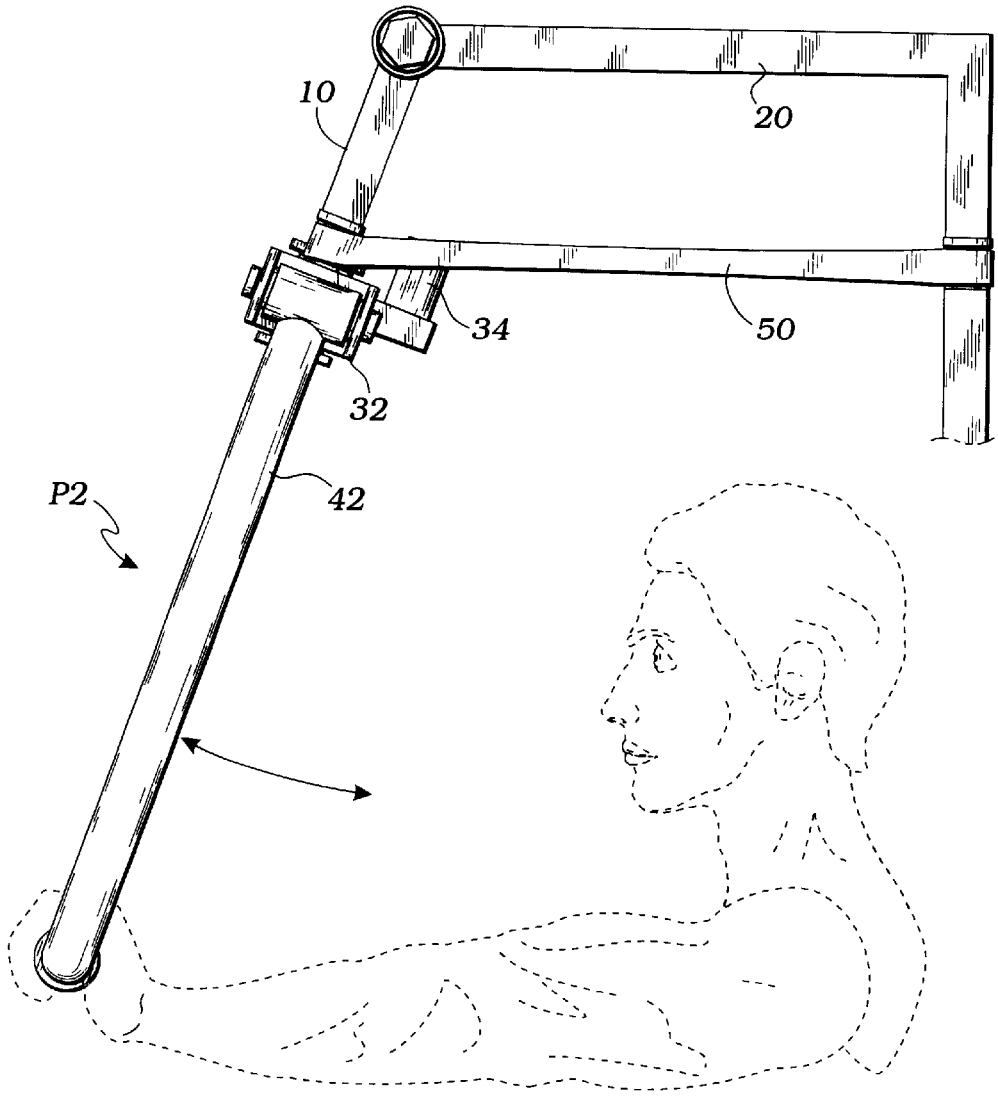
Figure 5:
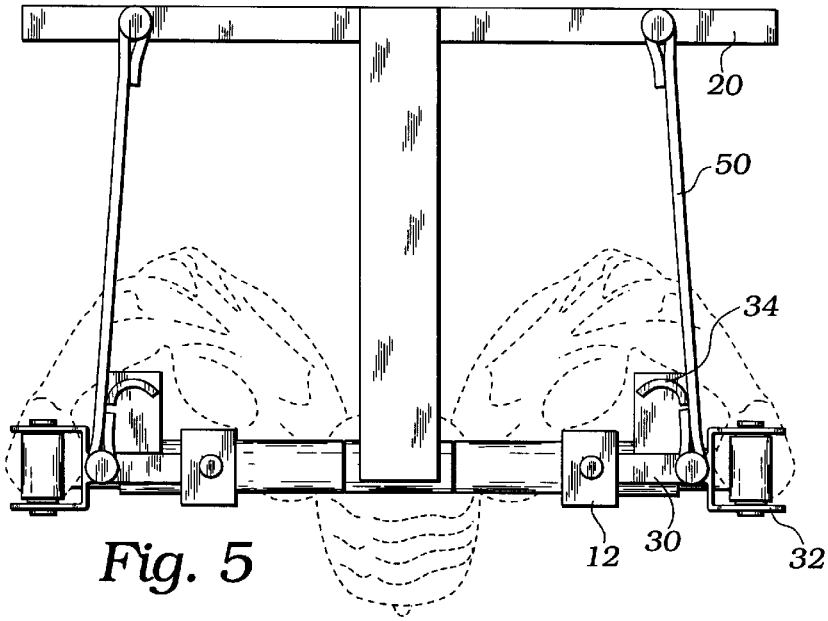
Figure 6:
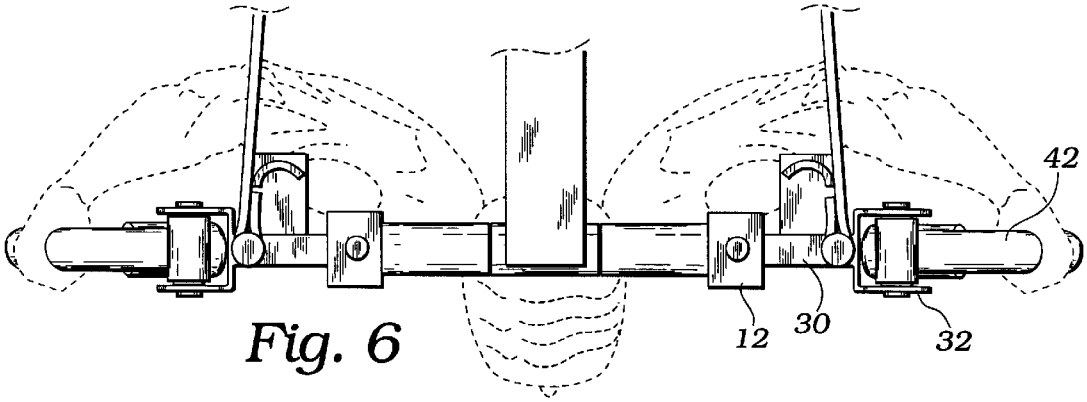
Figure 7:
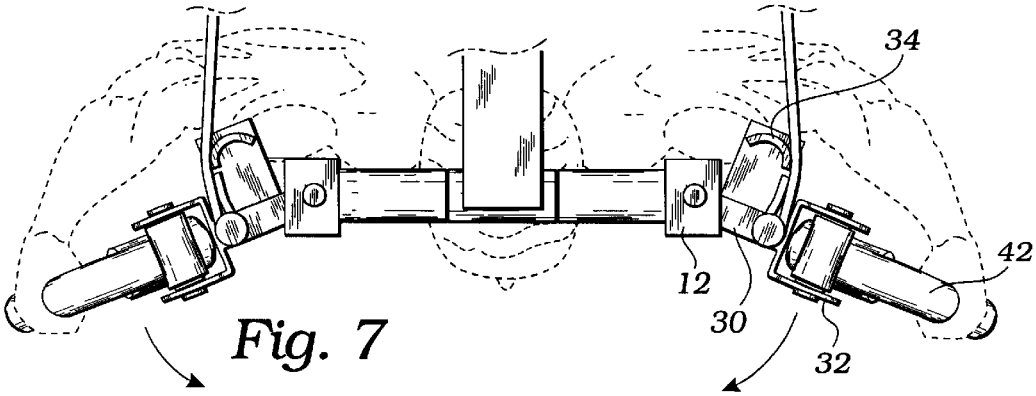

The above described drawing figures illustrate the invention, an exercise apparatus comprising a rocker arm 10 including a pair of integral spaced apart knuckle sockets 12 (knuckle socket means), the rocker arm 10 being pivotally engaged with a fixed frame structure 20 at a rocker arm axis 14 for vertical rotation between a first vertical attitude P1 (FIG. 3) and a second nin-vertical attitude P2 (FIG. 4) so as to enable arcuate motion of the knuckle sockets 12 as shown in FIGS. 3 and 4. A pair of knuckles 30 (knuckle means) are provided, with each one of the knuckles 30 pivotally engaged with one of the knuckle sockets 12 so as to enable independent horizontal rotational motion of the knuckles 30, as best shown in FIG. 7, while inhibiting vertical rotational motion thereof when the rocker arm 10 is positioned in the first vertical attitude PI, as shown in FIGS. 1, 2, 3 and 5–7.

A pair of exercise arms 40 (exercise arm means) each includes a proximal extension portion 42 integral with a distal handle portion 44. Each of the extension portions 42 are proximally pivotally engaged with an arm socket 32 (arm socket means) of one of the pair of knuckles 30 thereby enabling rotational motion of the exercise arms 40 away from each other in a common vertical plane, as shown in FIG. 2 while inhibiting lateral motion of the exercise arms 42 within the arm sockets 32, i.e., toward or away from the common vertical plane. The rocker arm 10 , knuckles 30 and exercise arms 40 are joined, as best shown in FIG. 1, such that with the rocker arm 10 positioned in the first vertical attitude P1 the exercise arms 40 are enabled for rotation divergently about the arm sockets 32 and then convergently along with the knuckles 30 about the knuckle sockets 12 against a resisting means 50, which may be a pair of elastic straps as shown in FIG. 1, established between the knuckles 30 and the fixed frame 20, in a fly exercise motion as clearly shown in FIGS. 5–7.

The exercise arms 40 are further enabled for driving the rocker arm 10 between the first vertical attitude P1 and the non-vertical attitude P2 about the rocker arm axis 14 against the resisting means 50, in a chest press exercise motion as shown in FIGS. 3 and 4. The resisting means is preferably at least one elastic member as shown in the figures, but may also be a weighted cable wherein the elastic member shown may be considered a steel cable or its equivalent, as is well known in exercise equipments, and wherein the post 52 may be a channel or pulley for directing the steel cable to a vertical attitude hanging downwardly to a weight (not shown) as is very well known in the exercise apparatus field.

The knuckles inventively may further include a contact surface 34 rigidly positioned on the knuckle 30 and movable therewith such that with rotation of the knuckle 30 about the knuckle socket 12 the contact surface 34 moves against the resisting means 50 for adjusting tension therein. The contact surface 34 is not useful in the chest press exercise motion mode as shown in FIGS. 3 and 4, but is effective in the fly exercise motion mode as shown in FIGS. 5–7 when the arms 40 are rotated along with the knuckles 30 about the knuckle sockets 12 as clearly shown in FIG. 7. As the arms 40 approach the front of the apparatus as shown by the arrows in FIG. 7 the incremental stretch of resisting means 50 becomes smaller with each equal decrement of angular rotation, thereby reducing the effectiveness of the exercise at its forward portion of the range of possible motion. To offset this condition, the contact surface 34 forces the resisting means 50 to further extend thereby increasing and compensating for lost elastic forces in the case of an elastic band type of resisting means, and to change the angle by which weighted cables are fed to the knuckles, so that in either case, compensation is achieved.

Figure 1:
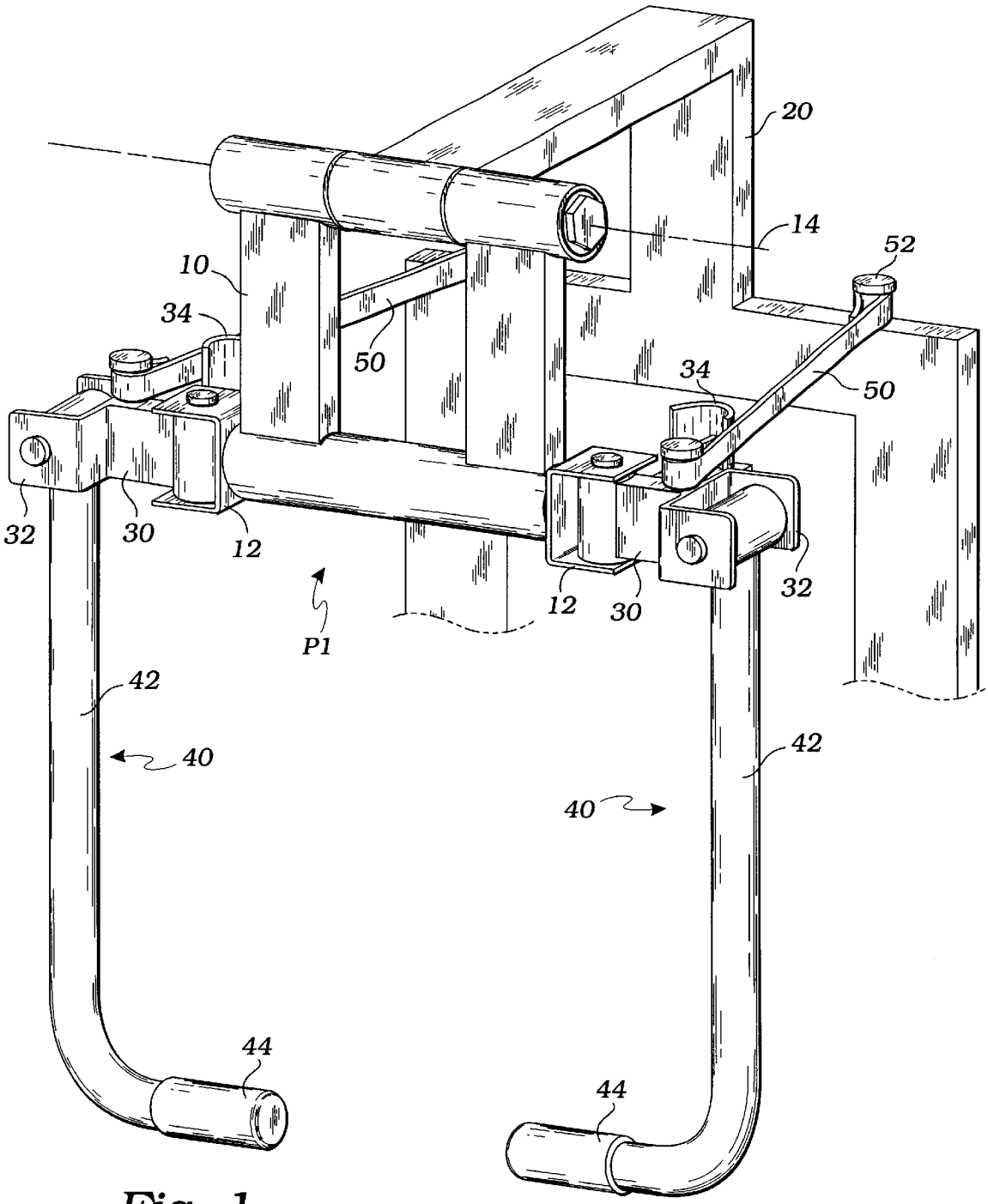
FIG. 1 is a perspective view of the preferred embodiment of the present invention.

The present exercise apparatus may further be described as having a rocker arm 10 including a pair of integral, spaced apart knuckle sockets 12, the rocker arm 10 pivotally engaged with a fixed frame structure 20 about a rocker arm axis 14 for rotation between a vertical attitude shown in FIG. 1, and an off-vertical, angled attitude as shown in FIG. 4. A pair of knuckles 30, are pivotally engaged with the knuckle sockets 12 for rotation about a knuckle socket axis. A pair of exercise arms 40, each including a proximal extension portion 42 (arms) formed at a right angle to, and integral with a distal handle portion 44, with each of the proximal extension portions 42 pivotally engaged with one of said knuckles 30 for rotation about a knuckle axis. The knuckle socket axes are positioned orthogonally to the knuckle axes as shown in FIG. 1. The knuckles 30 and exercise arms 40 are adapted, so that with the extension portions 42 positioned vertically, as shown in FIG. 1, and the handle portions positioned horizontally and directed toward each other, for rocker arm rotation about the rocker arm axis 14, in a press type exercise between the vertical attitude and the off-vertical, angled attitude. Further, with the exercise arms 40 rotated laterally apart about the knuckle axes, as shown in FIG. 2, for positioning in mutually, off-vertical, downwardly divergent, lateral positions, exercise arm rotation about the knuckle socket axes in a fly type exercise is enabled, whereby the exercise arms 40 are moved first toward and then away from each other as shown in FIGS. 7 and 6 respectively.

The exercise method of the present invention comprises engaging the rocker arm 10, including a pair of integral spaced apart knuckle sockets, pivotally, with the fixed frame structure 20 so that the rocker arm 10 is movable between the vertical attitude and an off-vertical, angled attitude; pivotally engaging the pair of knuckles 30, each of the knuckles with one of the knuckle sockets, for rotation about the knuckle socket axis thereof; pivotally engaging the pair of exercise arms 40, with said knuckles 30, each for rotation about the knuckle axis thereof; wherein, the knuckle socket axes are positioned orthogonally to the knuckle axes; pressing the exercise arms 40 to rotate the rocker arm 10 about the rocker arm axis 14, in the press type exercise between the vertical attitude and the off-vertical, angled attitude; and rotating the exercise arms 40 laterally apart about the knuckle axes to the mutually, off-vertical, downwardly divergent, lateral positions; and, then rotating the exercise arms 40 about the knuckle socket axes in the fly type exercise.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. An exercise apparatus comprising:

a rocker arm including a pair of integral, spaced apart knuckle sockets, the rocker arm pivotally engaged with a fixed frame structure about a rocker arm axis for rotation between a vertical attitude and an off-vertical, angled attitude;

a pair of knuckles, each of the knuckles pivotally engaged with one of the knuckle sockets for rotation about a knuckle socket axis thereof;

a pair of exercise arms, each of the exercise arms including a proximal extension portion formed at a right angle to, and integral with a distal handle portion, each of the proximal extension portions pivotally engaged with one of said knuckles for rotation about a knuckle axis thereof;

the knuckle socket axes positioned orthogonally to the knuckle axes;

the knuckles and exercise arms adapted, with the extension portions positioned vertically and the handle portions positioned horizontally and directed toward each other, for rocker arm rotation about the rocker arm axis, in a press type exercise between the vertical attitude and the off-vertical, angled attitude, and with the exercise arms rotated laterally apart about the knuckle axes for positioning in mutually, off-vertical, downwardly divergent, lateral positions, for exercise arm rotation about the knuckle socket axes in a fly type exercise whereby the exercise arms are enabled for being moved first toward and then away from each other.

2. An exercise method comprising: engaging a rocker arm, including a pair of integral spaced apart knuckle sockets, pivotally with a fixed frame structure so that the rocker arm is movable between a vertical attitude and an off-vertical, angled attitude; pivotally engaging a pair of knuckles, each of the knuckles with one of the knuckle sockets, for rotation about a knuckle socket axis thereof; pivotally engaging a pair of exercise arms with said knuckles, each for rotation about a knuckle axis thereof; wherein, the knuckle socket axes are positioned orthogonally to the knuckle axes; pressing the exercise arms to rotate the rocker arm about the rocker arm axis, in a press type exercise between the vertical attitude and the off-vertical, angled attitude; and rotating the exercise arms laterally apart about the knuckle axes to mutually, off-vertical, downwardly divergent, lateral positions; and, rotating the exercise arms about the knuckle socket axes in a fly type exercise.

* * * * *